US009926628B2

(12) United States Patent
Murphy, III

(10) Patent No.: US 9,926,628 B2
(45) Date of Patent: Mar. 27, 2018

(54) HIGH TEMPERATURE CONVERSION COATING ON STEEL AND IRON SUBSTRATES

(71) Applicant: Quaker Chemical Corporation, Conshohocken, PA (US)

(72) Inventor: James E. Murphy, III, Hatboro, PA (US)

(73) Assignee: Quaker Chemical Corporation, Conshohocken, PA (US)

( * ) Notice: Subject to any disclaimer, the term of this patent is extended or adjusted under 35 U.S.C. 154(b) by 310 days.

(21) Appl. No.: 14/199,058

(22) Filed: Mar. 6, 2014

(65) Prior Publication Data

US 2014/0251503 A1 Sep. 11, 2014

Related U.S. Application Data

(60) Provisional application No. 61/773,393, filed on Mar. 6, 2013.

(51) Int. Cl.

| | |
|---|---|
| ***C23C 22/07*** | (2006.01) |
| ***C23C 22/50*** | (2006.01) |
| ***C23C 22/36*** | (2006.01) |
| ***C23C 22/14*** | (2006.01) |
| ***C23C 22/10*** | (2006.01) |
| ***C23C 22/74*** | (2006.01) |

(52) U.S. Cl.
CPC ..... *C23C 22/36* (2013.01); *C23C 22/10* (2013.01); *C23C 22/14* (2013.01); *C23C 22/74* (2013.01)

(58) Field of Classification Search
CPC ..... C23C 22/07–22/23; C23C 22/42; C23C 22/47; C23C 22/50
USPC ..... 148/253–263
See application file for complete search history.

(56) References Cited

U.S. PATENT DOCUMENTS

| | | | | |
|---|---|---|---|---|
| 1,761,186 A | | 6/1930 | Baker et al. | |
| 2,257,313 A | | 9/1941 | Plummer | |
| 2,304,299 A | * | 12/1942 | Boyle | C23C 22/08 148/250 |
| 2,813,813 A | | 11/1957 | Ley et al. | |
| 2,856,322 A | | 10/1958 | Parson et al. | |
| 2,984,592 A | | 5/1961 | Logan | |
| 3,379,557 A | | 4/1968 | Hoover et al. | |
| 3,458,364 A | | 7/1969 | Upham | |
| 3,519,495 A | | 7/1970 | Plaxton | |

(Continued)

FOREIGN PATENT DOCUMENTS

| | | |
|---|---|---|
| CN | 1401820 A | 3/2003 |
| CN | 101457355 A | 6/2009 |

(Continued)

OTHER PUBLICATIONS

International Preliminary Report on Patentability for International Application PCT/US2014/021106, dated Sep. 8, 2015, 7 pages.

(Continued)

*Primary Examiner* — Lois L Zheng
(74) *Attorney, Agent, or Firm* — Morgan, Lewis & Bockius LLP

(57) ABSTRACT

The present invention is directed to compositions and methods for forming conversion coatings on a surface of a substrate by contacting a liquid composition to the surface of the substrate at a high temperature (i.e., 400° F. or above).

17 Claims, 5 Drawing Sheets

(56) References Cited

U.S. PATENT DOCUMENTS

| | | | | |
|---|---|---|---|---|
| 3,520,738 | A | 7/1970 | Matsubara et al. | |
| 3,573,997 | A | 4/1971 | Plaxton | |
| 4,017,335 | A | 4/1977 | Maloney | |
| 4,865,653 | A | 9/1989 | Kramer | |
| 4,950,339 | A | 8/1990 | Gehmecker et al. | |
| 5,164,056 | A | 11/1992 | Loeck | |
| 5,389,161 | A | 2/1995 | Wawra et al. | |
| 5,604,040 | A | 2/1997 | Sugama | |
| 5,891,268 | A | 4/1999 | Hacias et al. | |
| 5,976,272 | A | 11/1999 | Seidel et al. | |
| 6,376,433 | B1 | 4/2002 | Connor | |
| 6,638,370 | B2 | 10/2003 | Boulos | |
| 7,048,822 | B2 | 5/2006 | Yamashita et al. | |
| 7,294,210 | B2 | 11/2007 | Church | |
| 7,294,211 | B2 | 11/2007 | Sturgill et al. | |
| 7,422,629 | B1 | 9/2008 | Kawaguchi et al. | |
| 7,615,257 | B2 | 11/2009 | Jung et al. | |
| 7,811,391 | B2 | 10/2010 | Matzdorf et al. | |
| 2003/0000418 | A1 | 1/2003 | Boulos | |
| 2003/0066632 | A1 | 4/2003 | Bishop et al. | |
| 2003/0104228 | A1 | 6/2003 | Boulos | |
| 2008/0166575 | A1* | 7/2008 | Nittel | C23C 22/17 428/457 |
| 2008/0206592 | A1 | 8/2008 | Kim et al. | |

FOREIGN PATENT DOCUMENTS

| | | | |
|---|---|---|---|
| GB | 2016529 | A | 9/1979 |
| JP | 200087254 | A | 3/2000 |
| JP | 2001152357 | A | 6/2001 |
| JP | 2003064481 | A | 3/2003 |
| JP | 2014534351 | A | 12/2014 |
| KR | 19960003156 | | 3/1996 |
| RU | 2170285 | C2 | 7/2001 |
| WO | 198402722 | | 7/1984 |
| WO | 0004207 | A1 | 1/2000 |
| WO | 2013081574 | A1 | 6/2013 |
| WO | 2014138361 | | 9/2014 |

OTHER PUBLICATIONS

Patent Examination Report No. 1, Australian Government IP, dated Jan. 8, 2016, 3 pages.

Yang, K.H. et al., "Study of Vanadium-based Chemical Conversion Coating on the Corrosion Resistance of Magnesium Alloy", Materials Chemistry and Physics 101, pp. 480-485 (2007).

Sudagar, J. et al., "Electroless Ni-P Deposition with Vanadium Based Coating as Pretreatment on AZ91D Magnesium Alloy", Transactions of the Institute of Metal Finishing (Vo. 9, No. 3, pp. 129-136 (2012).

Lin, C.S. et al., "Formation of Phosphate/Permanganate Conversion Coating on Az31 Magnesium Alloy", Journal of the Electrochemical Society, 153 (3) B90-B96 (2006).

International Search Report for International Patent Application No. PCT/US2014/021106, dated Jun. 17, 2014, 3 pages.

Written Opinion for International Patent Application No. PCT/US2014/021106, dated Jun. 17, 2014, 6 pages.

Action dated Nov. 28, 2016, issued in corresponding Canadian Application No. 2,902,066.

Action dated Feb. 4, 2017, issued in corresponding Chinese Application No. 201480012167.8.

Action dated Sep. 12, 2016, issued in corresponding European Application No. 14 76 0796.

Action dated Jun. 6, 2016, issued in corresponding Japanese Application No. 2015-561642.

Action dated Aug. 2, 2016, issued in corresponding Korean Application No. 10-2015-7026192.

Action dated Jan. 2, 2017, issued in corresponding Korean Application No. 10-2015-7026192.

Action dated Dec. 19, 2016, issued in corresponding Russian application No. 2015141142/02.

* cited by examiner

HIGH TEMPERATURE CONVERSION COATING ON STEEL AND IRON SUBSTRATES

CROSS-REFERENCE TO RELATED APPLICATIONS

This application claims the benefit of U.S. Provisional Patent Application No. 61/773,393 filed Mar. 6, 2013 entitled "High Temperature Conversion Coating on Steel and Iron Substrates", incorporated by reference herein its entirety.

BACKGROUND OF THE INVENTION

A significant cost in the hot working of iron and steel is yield loss due to the continuous oxidation of surfaces in the forming or rolling processes. At many stages in these operations, iron oxide (also called scale), is knocked off intentionally either through mechanical or high pressure water means to prevent "rolled in scale" or "imprinted scale" defects. Yield loss of the finished product occurs not only in the removal of scale, but under storage conditions. In many cases, plate, coils, tubular goods, long products and shapes are stored in unprotected environments. Low temperature iron oxides (rust) are formed when these products are left out in the environment, resulting in additional yield loss.

One method by which to reduce scale and rust on a substrate such as a ferriferous substrate is to form a conversion coating, such as an iron phosphate coating, on the surface of the substrate. Cold temperature conversion coatings are often formed at 60° C. by reacting a 5% solution of a conversion coating composition to form 25 mg/ft$^2$ (after 30 seconds in a bath) of iron phosphate which protects the substrate from iron oxide and provides a lubricating surface for downstream operations and/or helps paint to adhere to the surface. Such cold temperature coatings generally must be formed using a submersion tank or a spray system involving a long run of spray zones to build up an effective amount of coating.

There is a need for methods and compositions for efficiently forming conversion coatings on ferriferous surfaces at high temperatures and high conversion rates without the need for submersion.

SUMMARY OF THE INVENTION

Accordingly, the present invention provides methods and compositions for forming conversion coatings on ferriferous substrates at high temperatures.

In one aspect, the present invention provides a method of forming a conversion coating on a ferriferous substrate, the method comprising contacting a surface of the ferriferous substrate with a liquid composition comprising phosphorous, wherein the surface of the ferriferous substrate is at a temperature of least 400° F. In further embodiments, the surface of the ferriferous substrate is at a temperature of at least 1100° F. In still further embodiments, the surface of the ferriferous substrate is at a temperature ranging from about 400° F. to about 1500° F. In yet further embodiments, the surface of the ferriferous substrate is at a temperature ranging from about 600° F. to about 1200° F.

In a further aspect and in accordance with the above, the present invention includes a method in which the conversion coating forms in less than 20 milliseconds upon contacting the substrate with the liquid composition comprising phosphorous.

In further embodiments and in accordance with any of the above, the liquid composition used to form the conversion coating comprises about 4.0-95.0% phosphoric acid.

In still further embodiments and in accordance with any of the above, the liquid composition further comprises about 0.0-10.0% sodium phosphate ester.

In yet further embodiments and in accordance with any of the above, the liquid composition further comprises about 0.0-10.0% potassium phosphate ester.

In still further embodiments and in accordance with any of the above, the liquid composition further comprises one or more of the following in any combination: (i) water 5.0-96.0%; (ii) sodium hydroxide, potassium hydroxide or ammonium hydroxide 0.0-1.0%; (iii) sodium chlorate or sodium fluoride 0.01-5.0%; (iv) sodium sulfonate, potassium Sulfonate or ammonium Sulfonate 0.01-5.0%; (v) amine polyglycol ether or ammonium, sodium or potassium dodecyl sulfate 0.0-1.0%; (vi) polyglycol ether or pentaethylene glycol monododecyl ether 0.0-1.0%.

In yet further embodiments and in accordance with any of the above, the liquid composition further comprises an accelerator, an anionic surfactant, a non-ionic surfactant, or some combination thereof.

In still further embodiments and in accordance with any of the above, the liquid composition further comprises dissolved divalent manganese cations.

In a further aspect and in accordance with any of the above, the contacting between the liquid composition and the surface of the ferriferous substrate is accomplished through a spray application of the liquid composition to the surface of said ferriferous substrate.

In a further embodiment and in accordance with any of the above, the conversion coating forms at a coating weight ranging between about 50 and about 100 mg/ft$^2$.

In a further aspect, the present invention includes a method of forming a conversion coating on a ferriferous substrate by contacting a surface of said ferriferous substrate with a liquid composition comprising phosphorous, where the liquid composition is applied at a temperature of at least 400° F. or at least 1100° F.

In a still further aspect, the present invention provides a method of forming a conversion coating on a substrate by contacting a surface of the substrate with a liquid composition comprising phosphorous, where the surface of the substrate is at a temperature of least 400° F.

BRIEF DESCRIPTION OF THE SEVERAL VIEWS OF THE DRAWINGS

The foregoing summary, as well as the following detailed description of certain embodiments of the invention will be better understood when read in conjunction with the following exemplary embodiments and the appended drawings.

DETAILED DESCRIPTION OF THE INVENTION

Figure 1:
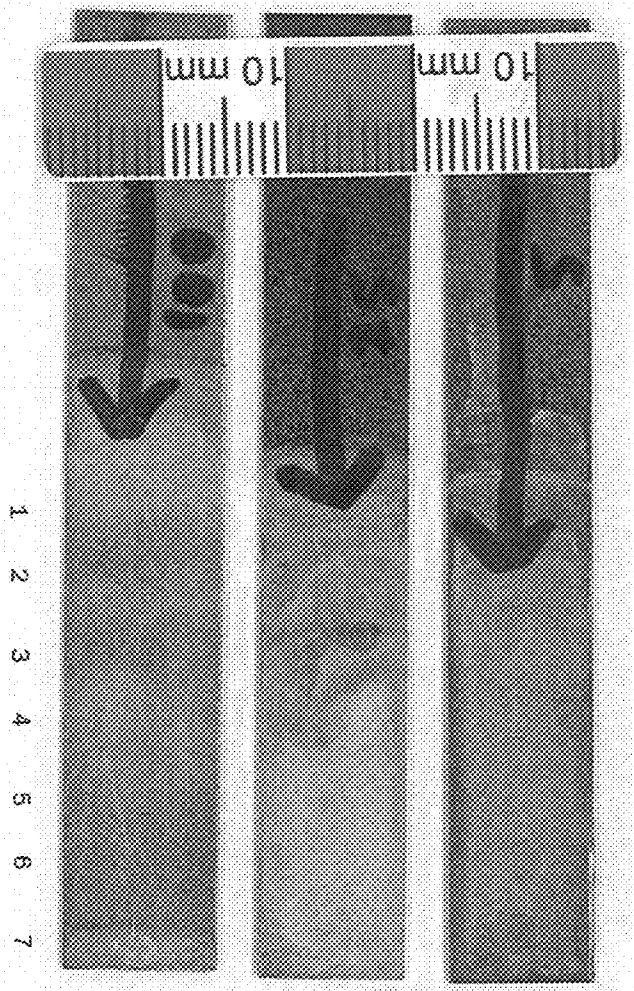
FIG. 1 is a photograph of steel panel samples immersed in conversion coating solutions.

Note that as used herein and in the appended claims, the singular forms "a," "an," and "the" include plural referents unless the context clearly dictates otherwise. Thus, for example, reference to "a polymerase" refers to one agent or mixtures of such agents, and reference to "the method" includes reference to equivalent steps and methods known to those skilled in the art, and so forth.

Unless defined otherwise, all technical and scientific terms used herein have the same meaning as commonly understood by one of ordinary skill in the art to which this invention belongs. All publications mentioned herein are incorporated herein by reference for the purpose of describing and disclosing devices, compositions, formulations and methodologies which are described in the publication and which might be used in connection with the presently described invention.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in the invention.

In the following description, numerous specific details are set forth to provide a more thorough understanding of the present invention. However, it will be apparent to one of skill in the art that the present invention may be practiced without one or more of these specific details. In other instances, well-known features and procedures well known to those skilled in the art have not been described in order to avoid obscuring the invention.

As used herein, the term "comprising" is intended to mean that the compositions and methods include the recited elements, but not excluding others. "Consisting essentially of" when used to define compositions and methods, shall mean excluding other elements of any essential significance to the composition or method. "Consisting of" shall mean excluding more than trace elements of other ingredients for claimed compositions and substantial method steps. Embodiments defined by each of these transition terms are within the scope of this invention. Accordingly, it is intended that the methods and compositions can include additional steps and components (comprising) or alternatively including steps and compositions of no significance (consisting essentially of) or alternatively, intending only the stated method steps or compositions (consisting of).

All numerical designations, e.g., pH, temperature, time, concentration, and molecular weight, including ranges, are approximations which are varied (+) or (−) by increments of 0.1. It is to be understood, although not always explicitly stated that all numerical designations are preceded by the term "about". The term "about" also includes the exact value "X" in addition to minor increments of "X" such as "X+0.1" or "X−0.1." It also is to be understood, although not always explicitly stated, that the reagents described herein are merely exemplary and that equivalents of such are known in the art.

I. Overview of the Invention

The present invention is directed to compositions and methods for forming conversion coatings on a surface of a substrate by contacting a liquid composition to the surface of the substrate at a high temperature (i.e., 400° F. or above).

In some aspects, the present invention provides methods for forming conversion coatings on a ferriferous or steel substrate at a high temperature. In further aspects, the conversion coating is formed by contacting the surface of the substrate with a liquid composition containing phosphorous, such that a phosphate coating forms on the surface of the substrate. In specific embodiments, the contacting forms the phosphate coating instantaneously due to the high temperature at which the liquid composition is applied to the surface of the substrate.

In further embodiments, the substrate (or at least the surface of the substrate) is at a high temperature. In other embodiments, the liquid composition is at a high temperature. In further embodiments, both the surface of the substrate and the liquid composition are at a high temperature. In still further embodiments, the substrate and the liquid composition are at the same, substantially the same, or different high temperatures, but where those high temperatures are a temperature of 400° F. or higher.

As will be discussed in further detail herein, the liquid composition may further contain surfactants, accelerators, and other components useful for forming a conversion coating.

II. Methods of Forming Conversion Coatings

In one aspect, the present invention is directed to methods of forming a conversion coating on a substrate at temperatures of 400° F. or higher. Although methods of cold temperature conversion coatings (i.e., application of a conversion coating composition at temperatures of around 140-212° F.) are often used to coat surfaces with a conversion coating, such cold temperature conversion coating methods generally require at least 30 seconds in an immersion bath to build up an effectively protective coating.

In contrast, the methods of the present invention form conversion coatings at high temperatures, resulting in instantaneous formation of the conversion coating on the surface of the substrate upon contact with the conversion composition. By "instantaneous formation" or forming the coating "instantaneously" as used herein is meant that a conversion coating forms within milliseconds of contacting the substrate with the coating composition. In exemplary embodiments, the conversion coating is formed in less than 20 milliseconds after contacting the substrate with the coating composition. In further exemplary embodiments, the conversion coating is formed in less than 100, 90, 80, 70, 60, 50, 40, 30, 20, 15, 10, 9, 8, 7, 6, 5, 4, 3, 2, 1, 0.5 milliseconds after contacting the substrate with the coating composition. In still further embodiments, the conversion coating is formed within 0.1-500, 0.5-450, 1-400, 5-350, 10-300, 20-250, 30-200, 40-150, 50-100, 25-90, 30-80, 35-70, 40-60, 45-50 milliseconds after contacting the substrate with the coating composition. The substrate may remain in contact with the conversion coating for any length of time, but is typically 0.1-500 milliseconds or about 0.5, 2.0, 3.0, 5.0, 10.0, 20 seconds, 30 seconds, 60 seconds or between 10 and 60 seconds or less than 40 seconds or less than 60 seconds. In some embodiments the contact time is greater than 1, 5, 10, or 20 seconds.

Conversion coating reaction rate typically doubles for every 10° C. increase, so at the operating temperatures employed in the methods of this invention, the coating reaction will be instantaneous, as discussed above. In some aspects, the high temperature at which the coating reaction occurs is at least 400° F., 500° F., 600° F., 700° F., 800° F., 900° F., 1000° F., 1100° F., 1200° F., 1300° F., 1400° F., 1500° F., 1600° F., 1700° F., 1800° F., 1900° F., 2000° F. In further embodiments, the methods of the present invention include forming conversion coatings at temperatures in the range of 400° F.-2500° F., 450-2400° F., 500° F.-2300° F., 650° F.-2200° F., 700° F.-2100° F., 750° F.-2000° F., 800° F.-1900° F., 850° F.-1800° F., 900° F.-1700° F., 950° F.-1600° F., 1000° F.-1500° F., 1050° F.-1400° F., 1100° F.-1300° F., 1150° F.-1200° F., 600° F.-1300° F., 610° F.-1250° F., 620° F.-1200° F., 630° F.-1150° F., 640° F.-1100° F., 650° F.-1050° F., 660° F.-1000° F., 670° F.-950° F., 680° F.-900° F., 700° F.-850° F., 650° F.-800° F. In still further embodiments, the methods of the present invention include forming conversion coatings at about 350° F., 375° F., 400° F., 425° F., 450° F., 475° F., 500° F., 525° F., 550° F., 575° F., 600° F., 625° F., 650° F., 675° F., 700° F., 725° F., 750° F., 775° F., 800° F., 825° F., 850° F., 875° F., 900° F., 925° F., 950° F., 975° F., 1000° F., 1025° F., 1050° F., 1075° F., 1100° F., 1125° F., 1150° F., 1175° F. 1200° F., 1225° F., 1250° F., 1275° F., 1300° F., 1325° F., 1350° F., 1375° F., 1400° F., 1425° F., 1450° F., 1475° F., 1500° F.

In further aspects and in accordance with any of the above, the methods of the present invention include forming the conversion coatings in which it is the substrate (or the surface or a portion of the substrate or its surface) that is at any of the high temperatures discussed herein for the conversion coating reaction. In some aspects and in accordance with any of the above, it is the composition applied to the substrate or the surface of the substrate that is at the high temperatures discussed herein for the conversion coating reaction. In still further aspects and in accordance with any of the above, both the substrate and the composition applied to the substrate are at the high temperatures discussed herein for the conversion coating reaction. As will be appreciated, the substrate and/or the composition applied to the substrate to form the conversion coating may both be at the same temperature or at different temperatures.

In a further aspect and in accordance with any of the above, the substrate used in methods of the present invention can be of any material amenable to being coated with a conversion coating. Such substrates include without limitation, iron, zinc, cadmium, and aluminum substrates (and alloys thereof). In exemplary embodiments, substrates of use in the present invention are ferriferous (containing, producing or yielding iron) substrates. In further embodiments, the substrates used in methods of the present invention comprise iron or an alloy of iron, such as steel.

As will be appreciated, the substrates of the invention can be of any shape or size amenable to being contacted with a coating composition of the invention. In non-limiting exemplary embodiments, substrates of the invention are planar sheets, plates, tubes, spherical shapes (including without limitation bearings) or irregularly shaped substrates comprising multiple components. Whatever their form, all or part of the substrates of use in the present invention are amenable to being coated in accordance with any of the methods discussed herein.

In a still further aspect and in accordance with any of the above, the conversion coating formed by methods of the invention includes any coating that provides resistance to corrosion and rust. In exemplary embodiments, such conversion coatings include without limitation chromate conversion coatings, phosphate conversion coatings, bluing, black oxide coatings, permanganate, stannate based, cerium based, lanthanum, vanadium, praseodymium conversion coatings, tannic based treatments, organic based (silane) coatings and anodizing coatings. Although for the sake of clarity the discussion herein is directed to phosphate coatings, it will be appreciated that the methods discussed herein can be applied to form a wide variety of conversion coatings known in the art.

In specific embodiments and in accordance with any of the above, the present invention is directed to forming phosphate conversion coatings on a ferriferous substrate at a high temperature. In still further embodiments, the present invention is directed to forming an iron phosphate coating on a ferriferous substrate at a temperature in accordance with any of the descriptions above. In yet further embodiments, the present invention is directed to forming an iron phosphate coating on a ferriferous substrate at a temperature of at least 400° F.-2500° F., 450-2400° F., 500° F.-2300° F., 650° F.-2200° F., 700° F.-2100° F., 750° F.-2000° F., 800° F.-1900° F., 850° F.-1800° F., 900° F.-1700° F., 950° F.-1600° F., 1000° F.-1500° F., 1050° F.-1400° F., 1100° F.-1300° F., and 1150° F.-1200° F. In still further embodiments, the methods of the present invention include methods for forming at least 400° F., 500° F., 600° F., 700° F., 800° F., 900° F., 1000° F., 1100° F., 1200° F., 1300° F., 1400° F., 1500° F., 1600° F., 1700° F., 1800° F., 1900° F., 2000° F. In further embodiments, the methods of the present invention include forming an iron phosphate coating on a ferriferous substrate at a temperature in the range of 400° F.-2500° F., 450-2400° F., 500° F.-2300° F., 650° F.-2200° F., 700° F.-2100° F., 750° F.-2000° F., 800° F.-1900° F., 850° F.-1800° F., 900° F.-1700° F., 950° F.-1600° F., 1000° F.-1500° F., 1050° F.-1400° F., 1100° F.-1300° F., 1150° F.-1200° F., 600° F.-1300° F., 610° F.-1250° F., 620° F.-1200° F., 630° F.-1150° F., 640° F.-1100° F., 650° F.-1050° F., 660° F.-1000° F., 670° F.-950° F., 680° F.-900° F., 700° F.-850° F., 650° F.-800° F. In still further embodiments, the methods of the present invention include methods of forming an iron phosphate coating on a ferriferous substrate at a temperature of about 350° F., 375° F., 400° F., 425° F., 450° F., 475° F., 500° F., 525° F., 550° F., 575° F., 600° F., 625° F., 650° F., 675° F., 700° F., 725° F., 750° F., 775° F., 800° F., 825° F., 850° F., 875° F., 900° F., 925° F., 950° F., 975° F., 1000° F., 1025° F., 1050° F., 1075° F., 1100° F., 1125° F., 1150° F., 1175° F. 1200° F., 1225° F., 1250° F., 1275° F., 1300° F., 1325° F., 1350° F., 1375° F., 1400° F., 1425° F., 1450° F., 1475° F., 1500° F. or higher. As discussed above, at such temperatures, the iron phosphate coating is formed instantaneously. In exemplary embodiments, the iron phosphate coating is formed in less than 20 milliseconds after contacting the substrate with the coating composition. In further exemplary embodiments, the conversion coating is formed in less than 100, 90, 80, 70, 60, 50, 40, 30, 20, 15, 10, 9, 8, 7, 6, 5, 4, 3, 2, 0.1, 0.5 milliseconds after contacting the substrate with the coating composition. In still further embodiments, the conversion coating is formed within 0.1-500, 0.5-450, 1-400, 5-350, 10-300, 20-250, 30-200, 40-150, 50-100 milliseconds after contacting the substrate with the coating composition. Coating compositions of use for forming iron phosphate coatings include any coating compositions known in the art and discussed in further detail herein.

In further aspects and in accordance with any of the above, a conversion coating is formed on a substrate at a high temperature by contacting the substrate with a liquid composition. The liquid composition may comprise a number of components, as is known in the art and is discussed in further detail herein. In exemplary embodiments, the liquid composition applied to the substrate at high temperature comprises phosphorous.

In still further aspects and in accordance with any of the above, the type of conversion coating formed at a high temperature as discussed herein and the coating weight will be dependent upon the concentrations and content of the conversion coating composition and the available surface substrate available for reaction. In exemplary embodiments, the conversion coating is an iron phosphate coating formed on a ferriferous substrate at high temperature with a weight that ranges between about 50-100, 55-95, 60-90, 65-85, 70-80 mg/ft$^2$. In further embodiments, the coating, which can in certain embodiments be an iron phosphate coating, has a weight that ranges between about 30-300, 35-250, 40-200, 45-150, 50-140, 55-130, 60-120, 65-110, 70-100, 75-90 mg/ft$^2$.

In further aspects and in accordance with any of the above, the present invention provides methods of applying a liquid composition to a substrate to form a conversion coating on one or more surfaces of that substrate at a high temperature. In some embodiments, the composition is applied in a bath application by immersing the substrate in the liquid composition. In some embodiments, the substrate is flooded by the liquid composition. In some embodiments, the composition is sprayed on the substrate (or a portion of the substrate) using methods known in the art, such as with a traditional spray header, or by air atomized application. Overspray may be eliminated through header designs known in the art. In embodiments in which the substrate is at the high temperatures described herein, the methods of the invention can be accomplished using spray application, in contrast to cold temperature conversion methods, because cold temperature conversion methods generally rely on the temperature of the solution to govern the temperature at which the conversion coating is formed, and spray application is generally not feasible at temperatures above the boiling point of water. Methods of the invention thus provide an advantage over cold temperature conversion methods, particularly for the coating of substrates with irregular surfaces or shapes that do not readily lend themselves to traditional dip-tank (bath) or spray washer applications. In further embodiments, the coating compositions of the invention are applied to a substrate, including a ferriferous substrate, at a temperature in accordance with any of the temperatures discussed herein, where the application of the coating composition is by way of a single bank of sprays with single headers for top and bottom.

In further aspects and in accordance with any of the above, the coating compositions can be applied at any point in various manufacturing processes, particularly points of manufacturing processes in which the substrate is as free of scale as possible. Such points may include without limitation: after a billet, bloom or slab leaves the mold; after a strip exits a continuous caster; after a once through roughing mill; after the last pass on a reversing rougher, reversing or steckle mill; after any descaling operation including a coil box; after the last stand of a finishing train.

As will be appreciated, the methods discussed herein can be used to form a single conversion coating on a substrate, or the methods can be repeated multiple times under identical or varying conditions of both coating composition and temperature, to alter the characteristic of the applied conversion coating and/or to add multiple coatings to the same substrate.

In further embodiments and in accordance with any of the above, the coating compositions of the invention are applied to a substrate after one or more surfaces of the substrate have been pre-cleaned or otherwise processed to remove scale using methods known in the art.

In specific embodiments, the present invention provides methods for forming a conversion coating on a surface, where those methods are not cold temperature (e.g., 140-212° F.) coating methods. In further embodiments, the methods of the invention include forming iron phosphate coatings on a ferriferous substrate using methods that are not cold temperature (e.g., 140-212° F.) coating methods.

In further embodiments, methods and compositions for forming conversion coatings known in the art are adapted and used for forming conversion coatings at temperatures of at least 400° F.-2500° F., 450-2400° F., 500° F.-2300° F., 650° F.-2200° F., 700° F.-2100° F., 750° F.-2000° F., 800° F.-1900° F., 850° F.-1800° F., 900° F.-1700° F., 950° F.-1600° F., 1000° F.-1500° F., 1050° F.-1400° F., 1100° F.-1300° F., and 1150° F.-1200° F. Such methods include without limitation methods such as those described in U.S. Pat. No. 3,458,364; U.S. Pat. No. 4,950,339; U.S. Pat. No. 7,294,210; WO1984002722; US20040062873; U.S. Pat. No. 2,856,322; U.S. Pat. No. 4,865,653; US20060237098; U.S. Pat. No. 5,891,268; U.S. Pat. No. 5,976,272; U.S. Pat. No. 6,638,370; US20030104228; U.S. Pat. No. 7,294,211; US20020142178; US20030066632; U.S. Pat. No. 2,257,313A; Lin, C. S. et al. ((2006) Journal of the Electrochemical Society, 153(3): B90-B96; Sudagar, J.; et al. ((2012) Transactions of the Institute of Metal Finishing, 90(3):129-136); Yang et al ((2007) Materials Chemistry and Physics, 101, 2-3, 480-485), each of which is hereby incorporated by reference in its entirety for all purposes and in particular for all teachings related to methods and compositions for forming conversion coatings on substrates.

III. Coating Compositions

As discussed above, the present invention provides methods for forming a conversion coating on a substrate at high temperatures. As will be appreciated, the type of conversion coating formed is dependent upon the components of the composition applied to the substrate. Compositions used to form conversion coatings of the invention are referred to herein as "conversion compositions," "coating compositions," "conversion compounds," "conversion compositions," and grammatical equivalents thereof.

In one aspect, conversion compositions of the invention comprise any component of use in forming a coating on a substrate, where that coating prevents corrosion, prevents rust, increases surface hardness, and improves the ability of paint to adhere to a surface. In further aspects, conversion compositions of the invention comprise without limitation powdered metals, metal oxides, chromate, phosphate, zinc, titanium, magnesium, permanganate, stannate, cesium, lanthanum, niobium, zirconium, hafnium, selenium, and tantalum. The conversion compositions of the invention may further include accelerators and/or surfactants. Accelerators of use in the invention can include without limitation nitrate, nitrite, chlorate, nitrobenzene sulfonic acid, hydroxylamine, and hydrogen peroxide.

In one aspect and in accordance with any of the above, the conversion compositions of the invention are liquid compositions comprising phosphorous. In exemplary embodiments, the liquid conversion compositions of the invention comprise without limitation phosphoric acid, sodium phosphate ester, potassium phosphate ester, or some combination thereof. In further embodiments, the liquid conversion compositions further include without limitation water, sodium hydroxide, potassium hydroxide, ammonium hydroxide, sodium chlorate, sodium fluoride, potassium sulfonate, sodium sulfonate, ammonium sulfonate, amine polyglycol ether, pentaethylene glycol monododecyl ether, or some combination thereof. The conversion compositions of the invention may further include an accelerator, an anionic surfactant, a non-ionic surfactant, dissolved divalent manganese cations, a passivating agent (including without limitation metallic nitrites and metallic dichromates), auxiliary ions (including without limitation sodium, zinc, cadmium, iron, copper, lead, nickel, cobalt, antimony, ammonium, chloride, bromide, nitrate and chlorate), solvents (including without limitation water, alcohols, ketones, or some mixture of one or more solvents), or some combination thereof.

In further aspects and in accordance with any of the above, conversion compositions of the present invention include one or more of the following components in the indicated concentrations in any combination:

(a) phosphoric acid 4.0-95.0%

(b) sodium phosphate ester 0.0-10.0%

(c) potassium phosphate ester 0.0-10.0%

(d) water 5.0-96.0%

(e) sodium hydroxide, potassium hydroxide or ammonium hydroxide 0.0-1.0%

(f) sodium chlorate or sodium fluoride 0.01-5.0%

(g) sodium sulfonate, potassium sulfonate or ammonium sulfonate 0.01-5.0%

(h) amine polyglycol ether or ammonium, sodium or potassium dodecyl sulfate 0.0-1.0%

(i) polyglycol ether or pentaethylene glycol monododecyl ether 0.0-1.0%.

The following sections provide further details on the components listed above. As will be appreciated, one or more of these components may be included in coating compositions of the invention in any combination and applied to a substrate in accordance with any of the methods described herein.

In accordance with any of the above, coating compositions of the invention may include component (a) phosphoric acid in a concentration of about 2.0-98.0, 4.0-95.0, 6.0-90.0, 8.0-80.0, 10.0-70.0, 15.0-60.0, 20.0-50.0, 25.0-40.0%. Coating compositions of the invention may further include phosphoric acid in a concentration of at least 2.0, 5.0, 10.0, 15.0, 20.0, 25.0, 30.0, 35.0, 40.0, 45.0, 50.0, 55.0, 60.0, 65.0, 70.0, 75.0, 80.0, 85.0, 90.0, 95.0%.

In accordance with any of the above, coating compositions of the invention may further include component (b) sodium phosphate ester in a concentration of about 0.0-20.0, 0.2-19.0, 0.4-18.0, 0.6-17.0, 0.8-16.0, 1.0-15.0, 1.5-14.4, 2.0-14.0, 2.5-13.4, 3.0-13.0, 3.5-12.4, 4.0-12.0, 4.5-11.6, 5.0-11.0, 6.0-10.0, 7.0-9.0%. Coating compositions of the invention may further include sodium phosphate ester in a concentration of at least 0.0, 0.2, 0.4, 0.6, 0.8, 1.0, 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, 6.0, 6.2, 6.4, 6.6, 6.8, 7.0, 7.2, 7.4, 7.6, 7.8, 8.0, 8.2, 8.4, 8.6, 8.8, 9.0, 9.2, 9.4, 9.6, 9.8, 10.0, 10.2, 10.4, 10.6, 10.8, 11.0, 11.2, 11.4, 11.6, 11.8, 12.0, 12.2, 12.4, 12.6, 12.8, 13.0, 13.2, 13.4, 13.6, 13.8, 14.0, 14.2, 14.4, 14.6, 14.8, 15.0, 15.2, 15.4, 15.6, 15.8, 16.0, 16.2, 16.4, 16.6, 16.8, 17.0, 17.2, 17.4, 17.6, 17.8, 18.0, 18.2, 18.4, 18.6, 18.8, 19.0, 19.2, 19.4, 19.6, 19.8, 20.0%

In accordance with any of the above, coating compositions of the invention may further include component (c) potassium phosphate ester in a concentration of about 0.0-20.0, 0.2-19.0, 0.4-18.0, 0.6-17.0, 0.8-16.0, 1.0-15.0, 1.5-14.4, 2.0-14.0, 2.5-13.4, 3.0-13.0, 3.5-12.4, 4.0-12.0, 4.5-11.6, 5.0-11.0, 6.0-10.0, 7.0-9.0%. Coating compositions of the invention may further include potassium phosphate ester in a concentration of at least 0.0, 0.2, 0.4, 0.6, 0.8, 1.0, 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, 6.0, 6.2, 6.4, 6.6, 6.8, 7.0, 7.2, 7.4, 7.6, 7.8, 8.0, 8.2, 8.4, 8.6, 8.8, 9.0, 9.2, 9.4, 9.6, 9.8, 10.0, 10.2, 10.4, 10.6, 10.8, 11.0, 11.2, 11.4, 11.6, 11.8, 12.0, 12.2, 12.4, 12.6, 12.8, 13.0, 13.2, 13.4, 13.6, 13.8, 14.0, 14.2, 14.4, 14.6, 14.8, 15.0, 15.2, 15.4, 15.6, 15.8, 16.0, 16.2, 16.4, 16.6, 16.8, 17.0, 17.2, 17.4, 17.6, 17.8, 18.0, 18.2, 18.4, 18.6, 18.8, 19.0, 19.2, 19.4, 19.6, 19.8, 20.0%

In accordance with any of the above, coating compositions of the invention may further include component (d) water in a concentration of about 5.0-96.0, 3.0-98.0, 3.5-93.0, 4.0-88.0, 4.5-83.0, 5.0-78.0, 5.5-73.0, 6.0-68.0, 6.5-63.0, 7.0-58.0, 7.5-53.0, 8.0-48.0, 8.5-43.0, 9.0-38.0, 9.5-33.0, 10.0-28.0, 10.5-23.0, 11.0-18.0, 11.5-13.0%. Coating compositions of the invention may further include water in a concentration of at least 5.0, 10.0, 15.0, 20.0, 25.0, 30.0, 35.0, 40.0, 45.0, 50.0, 55.0, 60.0, 65.0, 70.0, 75.0, 80.0, 85.0, 90.0, 95.0%.

In accordance with any of the above, coating compositions of the invention may further include component (e) sodium hydroxide, potassium hydroxide or ammonium hydroxide in a concentration of about 0.0-1.0, 0.0-2.0, 0.2-1.9, 0.4-1.8, 0.6-1.7, 0.8-1.6, 1.0-1.5, and 1.2-1.4%. Coating compositions of the invention may further include component (e) in a concentration of at least 0.0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0%.

In accordance with any of the above, coating compositions of the invention may further include component (f) sodium chlorate or sodium fluoride in a concentration of about 0.01-5.0, 0.00-10.0, 0.05-9.5, 0.25-9.0, 0.45-8.5, 0.65-8.0, 0.85-7.5, 1.05-7.0, 1.25-6.5, 1.45-6.0, 1.65-5.5, 1.85-5.0, 2.05-4.5, 2.25-4.0, 2.45-3.5, 2.65-3.0%. Coating compositions of the invention may further include component (f) in a concentration of at least 0.00, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.00, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.00, 2.05, 2.10, 2.15, 2.20, 2.25, 2.30, 2.35, 2.40, 2.45, 2.50, 2.55, 2.60, 2.65, 2.70, 2.75, 2.80, 2.85, 2.90, 2.95, 3.00, 3.05, 3.10, 3.15, 3.20, 3.25, 3.30, 3.35, 3.40, 3.45, 3.50, 3.55, 3.60, 3.65, 3.70, 3.75, 3.80, 3.85, 3.90, 3.95, 4.00, 4.05, 4.10, 4.15, 4.20, 4.25, 4.30, 4.35, 4.40, 4.45, 4.50, 4.55, 4.60, 4.65, 4.70, 4.75, 4.80, 4.85, 4.90, 4.95, 5.00, 5.05, 5.10, 5.15, 5.20, 5.25, 5.30, 5.35, 5.40, 5.45, 5.50, 5.55, 5.60, 5.65, 5.70, 5.75, 5.80, 5.85, 5.90, 5.95, 6.00%.

In accordance with any of the above, coating compositions of the invention may further include component (g) sodium sulfonate, potassium sulfonate or ammonium sulfonate in a concentration of about 0.01-5.0, 0.00-10.0, 0.05-9.5, 0.25-9.0, 0.45-8.5, 0.65-8.0, 0.85-7.5, 1.05-7.0, 1.25-6.5, 1.45-6.0, 1.65-5.5, 1.85-5.0, 2.05-4.5, 2.25-4.0, 2.45-3.5, 2.65-3.0%. Coating compositions of the invention may further include component (g) in a concentration of at least 0.00, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.00, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.00, 2.05, 2.10, 2.15, 2.20, 2.25, 2.30, 2.35, 2.40, 2.45, 2.50, 2.55, 2.60, 2.65, 2.70, 2.75, 2.80, 2.85, 2.90, 2.95, 3.00, 3.05, 3.10, 3.15, 3.20, 3.25, 3.30, 3.35, 3.40, 3.45, 3.50, 3.55, 3.60, 3.65, 3.70, 3.75, 3.80, 3.85, 3.90, 3.95, 4.00, 4.05, 4.10, 4.15, 4.20, 4.25, 4.30, 4.35, 4.40, 4.45, 4.50, 4.55, 4.60, 4.65, 4.70, 4.75, 4.80, 4.85, 4.90, 4.95, 5.00, 5.05, 5.10, 5.15, 5.20, 5.25, 5.30, 5.35, 5.40, 5.45, 5.50, 5.55, 5.60, 5.65, 5.70, 5.75, 5.80, 5.85, 5.90, 5.95, 6.00%.

In accordance with any of the above, coating compositions of the invention may further include component (h) amine polyglycol ether or ammonium, sodium or potassium dodecyl sulfate in a concentration of about 0.0-1.0, 0.05-4.5, 0.10-4.0, 0.15-3.5, 0.20-3.0, 0.25-2.5, 0.30-2.0, 0.35-1.5, 0.40-1.0%. Coating compositions of the invention may further include component (h) in a concentration of at least 0.00, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.00, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.00%.

In accordance with any of the above, coating compositions of the invention may further include (i) polyglycol ether or pentaethylene glycol monododecyl ether in a concentration of about 0.0-1.0, 0.05-4.5, 0.10-4.0, 0.15-3.5, 0.20-3.0, 0.25-2.5, 0.30-2.0, 0.35-1.5, 0.40-1.0%. Coating compositions of the invention may further include component (i) in a concentration of at least 0.00, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.00, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.00%.

In some embodiments, coating compositions as described above may be diluted on a volume per volume basis in additional water for actual use. In some embodiments, where less than 100% of the coating composition formulation is desired to contact a metal surface to provide a protective layer, the coating composition formulation may be combined with water (e.g. tap water) on a volume basis to achieve solution percentages of about 5%; 10%; 15%; 20%; 25%; 30%; 35%; 40%; 45%; 50%; 55%; 60%; 65%; 70%; 75%; 80%; 85%; 90%; 95%; 99%; about 15% to about 45%; about 20% to about 50%; about 25% to about 60%; about 30% to about 65%; about 35% to about 70%; about 40% to about 75%; about 45% to about 80%; or about 50% to about 85%.

In some embodiments, the coating compositions as described above are used in 100% concentration, i.e. are not mixed with additional water.

EXAMPLES

Example 1

A conversion coating solution of embodiments of the present invention was prepared and mixed with water in a concentration by volume as noted in the tables below. Steel panels were weighed, heated, dipped in the solution for 30 seconds, weighed, heated for the noted time and temperature, cooled, and re-weighed. Details and results are included in the charts below:

30% solution in tap $H_2O$ (by volume)

1) Clean panel heated on hot plate to 700° F. and dipped for 30 seconds
2) Allow to dry and re-weigh
3) Placed in muffle furnace @ 1120° C. for one minute
4) Allow to cool and re-weigh again

| | Weight | | |
|---|---|---|---|
| Clean 1010 Steel Panel | 23.9775 g | | |
| Coated 1010 Steel Panel | 23.9808 g | Coating Weight: | 3.3 mg |
| Heat Treated 1010 Steel Panel | 24.0530 g | Oxidation: | 72.3 mg |

30% solution in tap $H_2O$ (by volume)

1) Clean panel heated on hot plate to 700° F. and dipped for 30 seconds
2) Allow to dry and re-weigh
3) Placed in muffle furnace @ 1120° C. for one hour
4) Allow to cool and re-weigh again

| | Weight | | |
|---|---|---|---|
| Clean 1010 Steel Panel | 24.0724 g | | |
| Coated 1010 Steel Panel | 24.0825 g | Coating Weight: | 10.1 mg |
| Heat Treated 1010 Steel Panel | 25.2064 g | Oxidation: | 1123.9 mg |

10% solution in tap $H_2O$ (by volume)

1) Clean panel heated on hot plate to 700° F. and dipped for 30 seconds
2) Allow to dry and re-weigh
3) Placed in muffle furnace @ 1120° C. for one hour
4) Allow to cool and re-weigh again

| | Weight | | |
|---|---|---|---|
| Clean 1010 Steel Panel | 23.9579 g | | |
| Coated 1010 Steel Panel | 23.9630 g | Coating Weight: | 5.1 mg |
| Heat Treated 1010 Steel Panel | 25.0319 g | Oxidation: | 1068.9 mg |

20% solution in tap $H_2O$ (by volume)

1) Clean panel heated on hot plate to 700° F. and dipped for 30 seconds
2) Allow to dry and re-weigh
3) Placed in muffle furnace @ 1120° C. for one hour
4) Allow to cool and re-weigh again

| | Weight | | |
|---|---|---|---|
| Clean 1010 Steel Panel | 24.0266 g | | |
| Coated 1010 Steel Panel | 24.0329 g | Coating Weight: | 6.3 mg |
| Heat Treated 1010 Steel Panel | 25.0688 g | Oxidation: | 1035.9 mg |

50% solution in tap $H_2O$ (by volume)

1) Clean panel heated on hot plate to 700° F. and dipped for 30 seconds
2) Allow to dry and re-weigh
3) Placed in muffle furnace @ 1120° C. for one hour
4) Allow to cool and re-weigh again

| | Weight | | |
|---|---|---|---|
| Clean 1010 Steel Panel | 24.0968 g | | |
| Coated 1010 Steel Panel | 24.1025 g | Coating Weight: | 5.7 mg |
| Heat Treated 1010 Steel Panel | 25.1646 g | Oxidation: | 1062.1 mg |

Blank (Clean and uncoated panel)

1) Clean panel
2) Placed in muffle furnace @ 1120° C. for one hour
3) Allow to cool and re-weigh

| | Weight | | |
|---|---|---|---|
| Clean 1010 Steel Panel | 24.1106 g | | |
| Heat Treated 1010 Steel Panel | 25.3767 g | Oxidation: | 1266.1 mg |

As demonstrated by the results in the tables above, dipping the heated panels in the conversion coating solution for 30 seconds provided a measurable coating on the panels. Further, the panels treated with the conversion coating solution resulted in a significantly lower amount of oxidation after heating in the muffle furnace as compared to the uncoated panels.

Example 2

A conversion coating solution of embodiments of the present invention was prepared and mixed with water in concentrations by volume of 5% coversion coating solution and 25% conversion coating solution. A 100% conversion coating solution (i.e. not mixed with water) was also used. Steel panels were heated to 700° F., and were then immersed in each of the 5%, 25%, and 100% solutions.

FIG. 1 shows a photograph of the samples. From top to bottom: immersed in 5%, 25% and 100% conversion coating solutions. On the right side of the samples are located the areas which were immersed. The areas on the left did not contact the solutions.

Several energy dispersive spectroscopy ("EDS") spectra were obtained on the samples, on spots numbered 1-7 from left to right. Because the surface appearance of the samples immersed in the 25% and 100% solutions was quite inhomogeneous, seven EDS spectra were obtained. Because the surface appearance of the sample immersed in 5% solution was more homogeneous, only four spectra were obtained (roughly at positions 1-3-5-7). The EDS settings used were: acc.V 5 keV, magn. 100×, spot 99, 33000 cps, Lsec 50.

Figure 2:
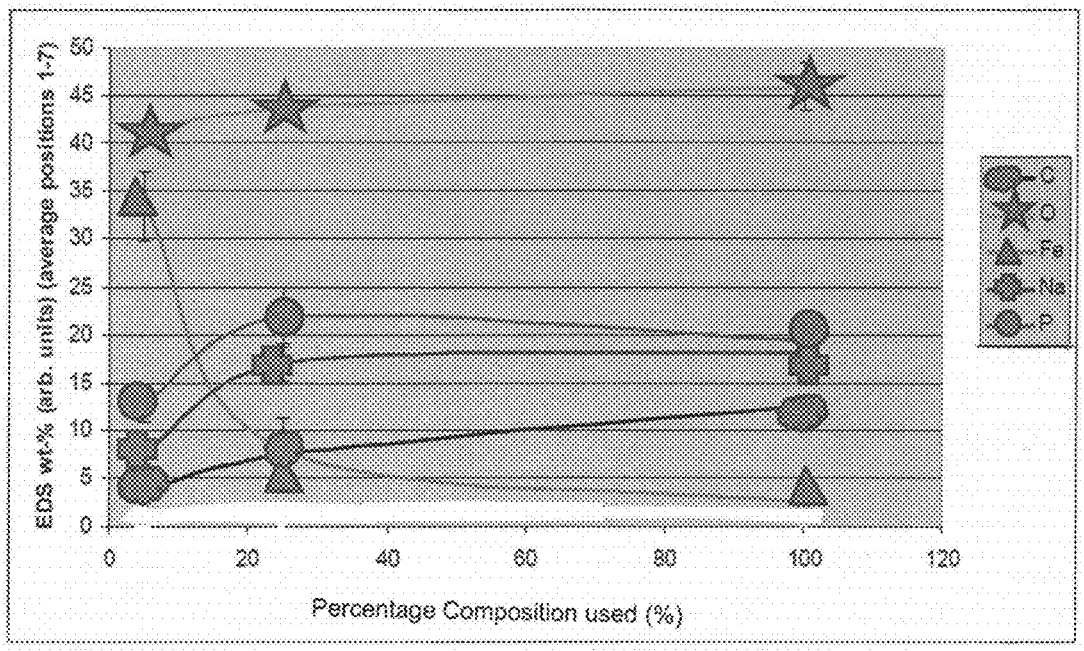
FIG. 2 shows EDS results of immersed steel panel samples.
Figure 2:
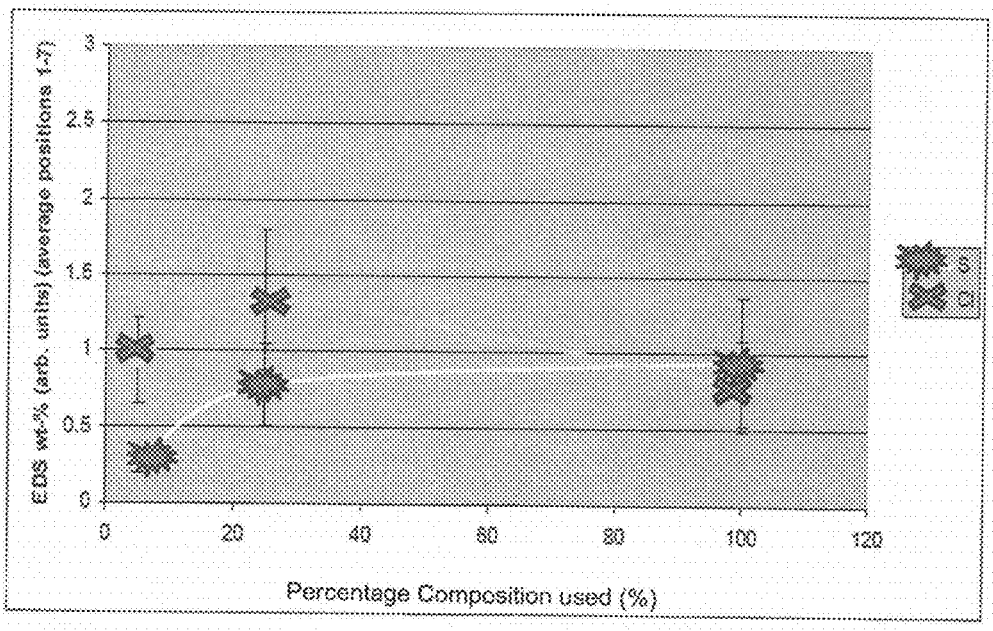

It was found that the composition of the various elements was fairly consistent going from position 1 to 7. The amounts of the various elements was averaged and plotted versus the concentration of the immersion liquid. The result can be seen in FIG. 2.

The most abundant element on the surfaces is oxygen. The second most abundant element is phosphorus, indicating that under the chosen immersion conditions the measurement of phosphorus is easily achievable. Phosphorus is associated in phosphates.

Sodium is also present in large quantities, which could have reacted with phosphates, but may also be present in dried-in hydroxide form. There are also small amounts of organic material in the formulation of the conversion coating, and it can be seen that the organic nature of the surface layer increases with the concentration of the immersion liquid. The very small amounts of Cl and S in the formulation can also be traced back on the surface. The amount of Fe can be seen to decrease significantly as the concentration of the immersion liquid increases, showing that the coverage of the panel becomes significant.

Figure 3:
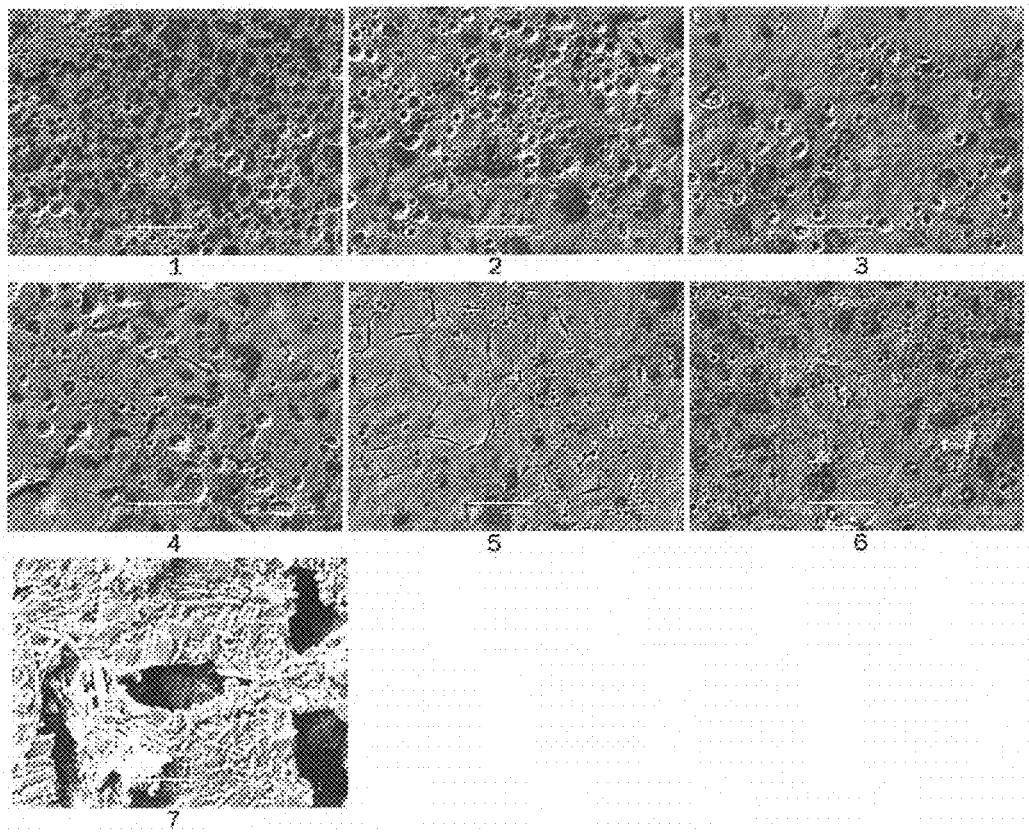
FIG. 3 shows SEM images of steel panel samples immersed in 100% conversion coating solution.
Figure 4:
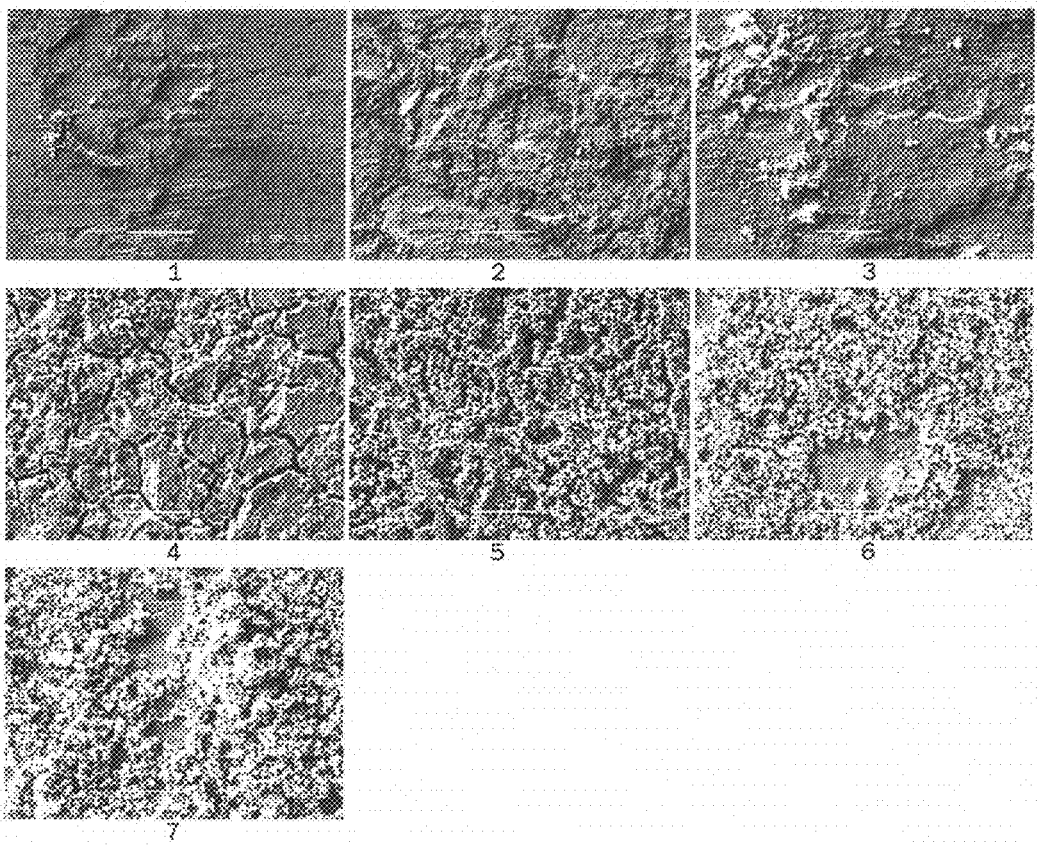
FIG. 4 shows SEM images of steel panel samples immersed in 25% conversion coating solution.
Figure 5:
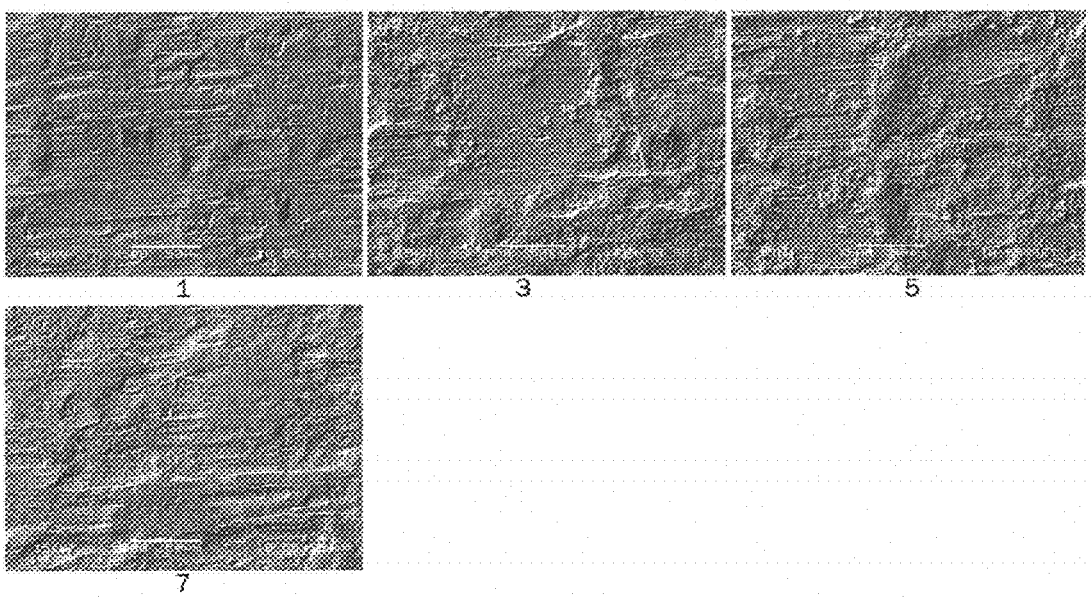
FIG. 5 shows SEM images of steel panel samples immersed in 5% conversion coating solution.

FIGS. 3, 4, and 5 show scanning electron microscopy ("SEM") images at the positions 1-7 on the three samples. The nearly complete surface coverage of the sample immersed in 100% conversion coating solution is clearly visible. At position 7, loose material is likely deposited due to remains of a droplet after retracting the strip from the fluid.

For the sample immersed in 25% conversion coating solution, the substrate can be seen here and there, but the EDS data indicate that the surface of positions 1-3 is still covered with a significant surface layer, which as can be inferred, has a more subtle nature, i.e. covers the surface very well, but leaves the original texture unaffected. At positions 4-7, a very brittle, dusty material appears to cover the surface (also visible with the naked eye).

For the sample immersed in 5% conversion coating solution, the substrate can be clearly seen at all positions, together with the EDS data suggesting that the surface layer has become significantly thinner.

The results and data demonstrate that the nature and quality of the deposited/reacted surface layer depends significantly on the concentration of the immersion fluid.

The present specification provides a complete description of the methodologies, systems and/or structures and uses thereof in example aspects of the presently-described technology. Although various aspects of this technology have been described above with a certain degree of particularity, or with reference to one or more individual aspects, those skilled in the art could make numerous alterations to the disclosed aspects without departing from the spirit or scope of the technology hereof. Since many aspects can be made without departing from the spirit and scope of the presently described technology, the appropriate scope resides in the claims hereinafter appended. Other aspects are therefore contemplated. Furthermore, it should be understood that any operations may be performed in any order, unless explicitly claimed otherwise or a specific order is inherently necessitated by the claim language. It is intended that all matter contained in the above description and shown in the accompanying drawings shall be interpreted as illustrative only of particular aspects and are not limiting to the embodiments shown. Unless otherwise clear from the context or expressly stated, any concentration values provided herein are generally given in terms of admixture values or percentages without regard to any conversion that occurs upon or following addition of the particular component of the mixture. To the extent not already expressly incorporated herein, all published references and patent documents referred to in this disclosure are incorporated herein by reference in their entirety for all purposes. Changes in detail or structure may be made without departing from the basic elements of the present technology as defined in the following claims.

What is claimed:

1. A method of forming a conversion coating on a ferriferous substrate, said method comprising contacting a surface of said ferriferous substrate with a liquid composition comprising a) 1.0-10.0% sodium phosphate ester and/or potassium phosphate ester, b) at least 0.1% of sodium hydroxide, potassium hydroxide, ammonium hydroxide, or a combination thereof, and c) at least 25% phosphoric acid, wherein said surface of said ferriferous substrate is at a temperature of least 400° F.

2. The method of claim 1, wherein said surface of said ferriferous substrate is at a temperature of at least 1100° F.

3. The method of claim 1, wherein during said contacting step, said surface of said ferriferous substrate is at a temperature ranging from about 400° F. to about 1500° F.

4. The method of claim 1, wherein during said contacting step, said surface of said ferriferous substrate is at a temperature ranging from about 600° F. to about 1200° F.

5. The method of claim 1, wherein said conversion coating forms in less than 20 milliseconds upon said contacting step.

6. The method of claim 1, wherein said liquid composition further comprises 0.2-10.0% potassium phosphate ester.

7. The method of claim 1, wherein said liquid composition further comprises one or more of the following:

Water 5.0-96.0%

Sodium Hydroxide, Potassium Hydroxide or Ammonium Hydroxide 0.1-1.0%

Sodium Chlorate or Sodium Fluoride 0.01-5.0%

Sodium Sulfonate, or Potassium Sulfonate or Ammonium Sulfonate 0.01-5.0%

Amine Polyglycol Ether or Ammonium, Sodium or Potassium Dodecyl Sulfate 0.0-1.0%

Polyglycol Ether or Pentaethylene glycol monododecyl ether 0.0-1.0%.

8. The method of claim 1, wherein said liquid composition further comprises an accelerator, an anionic surfactant, a non-ionic surfactant, or some combination thereof.

9. The method of claim 1, wherein said liquid composition further comprises dissolved divalent manganese cations.

10. The method of claim 1, wherein said contacting is accomplished through a spray application of said liquid composition to said surface of said ferriferous substrate.

11. The method of claim 1, wherein said conversion coating forms at a coating weight ranging between about 50 and about 100 $mg/ft^2$.

12. The method of claim 1 wherein the substrate is in contact with the liquid composition for greater than 10 seconds and less than 40 seconds.

13. A method of forming a conversion coating on a ferriferous substrate, said method comprising contacting a surface of said ferriferous substrate with a liquid composition comprising a) 1.0-10.0% sodium phosphate ester and/or potassium phosphate ester, b) at least 0.1% of sodium hydroxide, potassium hydroxide, ammonium hydroxide, or a combination thereof, and c) at least 25% phosphoric acid, wherein said liquid composition is applied at a temperature of at least 400° F.

14. The method of claim 13, wherein said liquid composition is applied at a temperature of at least 1100° F.

15. A method of forming a conversion coating on a substrate, said method comprising contacting a surface of said substrate with a liquid composition comprising a) 1.0-10.0% sodium phosphate ester and/or potassium phosphate ester, b) at least 0.1% of sodium hydroxide, potassium hydroxide, ammonium hydroxide, or a combination thereof, and c) at least 25% phosphoric acid, wherein said surface of said substrate is at a temperature of least 400° F.

16. A method of forming a conversion coating on a ferriferous substrate, said method comprising contacting a surface of said ferriferous substrate with a liquid composition comprising a) 1.0-10.0% sodium phosphate ester and/or potassium phosphate ester, b) at least 0.1% of sodium hydroxide, potassium hydroxide, ammonium hydroxide, or a combination thereof, and c) at least 25% phosphoric acid, wherein said surface of said ferriferous substrate is at a temperature of least 1700° F.

17. A method of forming a conversion coating on a ferriferous substrate, said method comprising contacting a surface of said ferriferous substrate with a liquid composition comprising a) 1.0-10.0% sodium phosphate ester and/or potassium phosphate ester, b) at least 0.1% of sodium hydroxide, potassium hydroxide, ammonium hydroxide, or a combination thereof, and c) at least 25% phosphoric acid, wherein said surface of said ferriferous substrate is at a temperature of least 1800° F.

* * * * *